US011493204B2

(12) United States Patent
He

(10) Patent No.: US 11,493,204 B2
(45) Date of Patent: Nov. 8, 2022

(54) BURNER GUN WITH SAFETY SWITCH

(71) Applicant: Ta-Jen He, New Taipei (TW)

(72) Inventor: Ta-Jen He, New Taipei (TW)

(73) Assignee: REKROW INDUSTRIAL INC., New Taipei (TW)

( * ) Notice: Subject to any disclaimer, the term of this patent is extended or adjusted under 35 U.S.C. 154(b) by 241 days.

(21) Appl. No.: 17/106,156

(22) Filed: Nov. 29, 2020

(65) Prior Publication Data

US 2022/0170632 A1 Jun. 2, 2022

(51) Int. Cl.

| | |
|---|---|
| ***F23D 14/46*** | (2006.01) |
| ***F23D 14/28*** | (2006.01) |
| ***F23D 14/38*** | (2006.01) |
| ***F23D 14/72*** | (2006.01) |

(52) U.S. Cl.

CPC ..... *F23D 14/465* (2013.01); *F23D 14/28* (2013.01)

(58) Field of Classification Search

CPC ..... F23D 14/28; F23D 14/38; F23D 14/465; F23D 14/72; F23D 2209/00

See application file for complete search history.

(56) References Cited

U.S. PATENT DOCUMENTS 1,830,580 A * 11/1931 Wappat ..... B27B 9/02 30/376
3,155,140 A * 11/1964 Wilson ..... F23D 14/38 431/153
2007/0082308 A1* 4/2007 Lin ..... F23D 14/465 431/344

FOREIGN PATENT DOCUMENTS

KR 200440429 Y1 * 6/2008

* cited by examiner

*Primary Examiner* — Jorge A Pereiro
*Assistant Examiner* — Logan P Jones

(57) ABSTRACT

A burner gun includes a case, an ignition device, a switch and a operational part. By the switch and an operation rail in the case, the ignition device can only be activated by correctly operating the switch and pulling the operational part. The ignition device cannot activated by pulling the operational part if the switch is not correctly operated, so that the ignition device is prevented from being activated unintentionally to reduce possibility of causing fire disasters.

6 Claims, 17 Drawing Sheets

BURNER GUN WITH SAFETY SWITCH

BACKGROUND OF THE INVENTION

1. Fields of the Invention

The present invention relates to a burner gun, and more particularly, to a burner gun equipped with a safety switch to prevent from unintentionally pulling the operational part to ignite the burner gun.

2. Descriptions of Related Art

Burner guns are a widely choices to ignite and generally includes a gun-shaped case with a gas storage and an ignition device received therein. A normal-close path is formed between the gas storage and the ignition device. When the operational part is pulled, the ignition device is activated to ignite the gas, and the flame ejects from the burner tube of the burner gun. The burner guns are a convenient tools to ignite by simply pulling the operational part.

However, the burner guns may be activated unintentionally to cause disasters. Therefore, a safe burner gun is needed.

The present invention intends to provide a burner gun equipped with a safety switch to eliminate shortcomings mentioned above.

SUMMARY OF THE INVENTION

The present invention relates to a burner gun and comprises a case having a burner tube on the first end thereof, and a chamber is defined in the second end of the case. The case includes a slot which communicates with the chamber. The slot includes a first locking section and a first ignition section. The case includes an operation rail formed in the inside thereof which faces the chamber. The operation rail includes a second locking section and a second ignition section which is formed with the second locking section. An ignition device is located in the chamber connected with the burner tube. A switch includes a lever and a movable part. The lever is partially located in the slot. The movable part is located in the chamber and includes a body and a protrusion which is formed with the body. The body is connected to the ignition device and the lever. The protrusion extends from the body and protrudes into the operation rail. The body is axially moved to activate the ignition device. A recovery member is located in the chamber and linked to the body. An operational part is connected to the case. A portion of the operational part protrudes beyond the case, and another portion of the operational part is accommodated in the chamber and located corresponding to the body. When the lever is shifted along the slot, the lever drives the body in the same direction as the lever moves. When the lever is located at the first locking section, the protrusion is located at the second locking position, and the body cannot move axially by operating the operational part. When the lever is moved to the first ignition section, the protrusion is located at the second ignition section, and the body moves axially by operating the operational part. When the lever and the operational part are released, the recovery member brings the body back, and the lever moves to the first locking section. An operational part is connected to the case, wherein a portion of the operational part protrudes beyond the case, and another portion of the operational part is accommodated in the chamber and located corresponding to the body. When the lever is shifted along the slot to move the body in the same direction as the lever moves, and the lever is located at the first locking section, the protrusion is located at the second locking position. The body cannot move axially by operating the operational part. When the lever is moved to the first ignition section, the protrusion is located at the second ignition section, the body moves axially by operating the operational part. When the lever and the operational part are released, the recovery member brings the body back in a recovery direction, and the lever moves to the first locking section.

The primary object of the present invention is to provide a burner gun with a safety switch. The ignition device cannot be activated by pulling the operational part if the switch is not correctly operated, so as to reduce the possibility of causing fire disasters.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
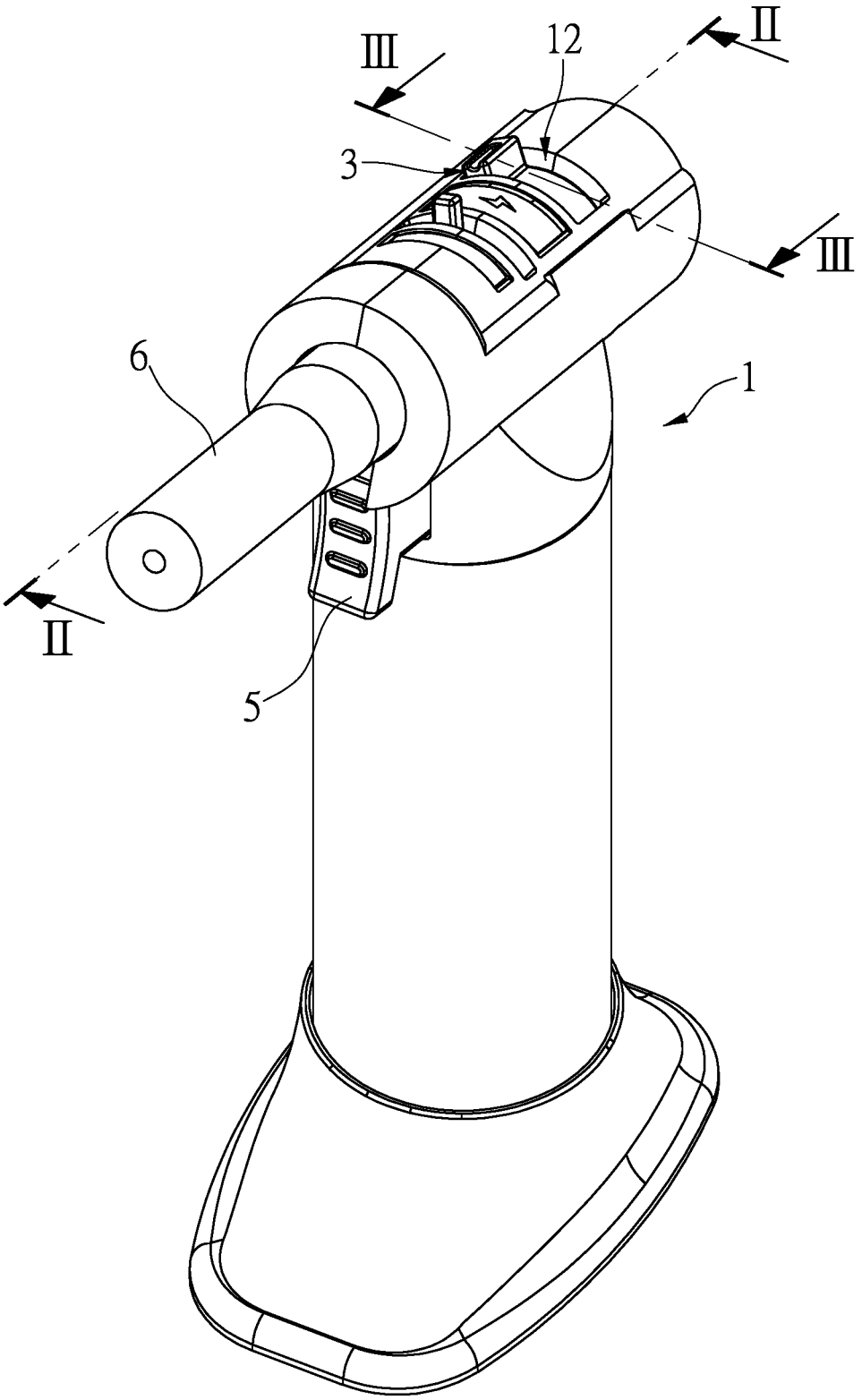
FIG. 1 is a perspective view to show the burner gun of the present invention.
Figure 2:
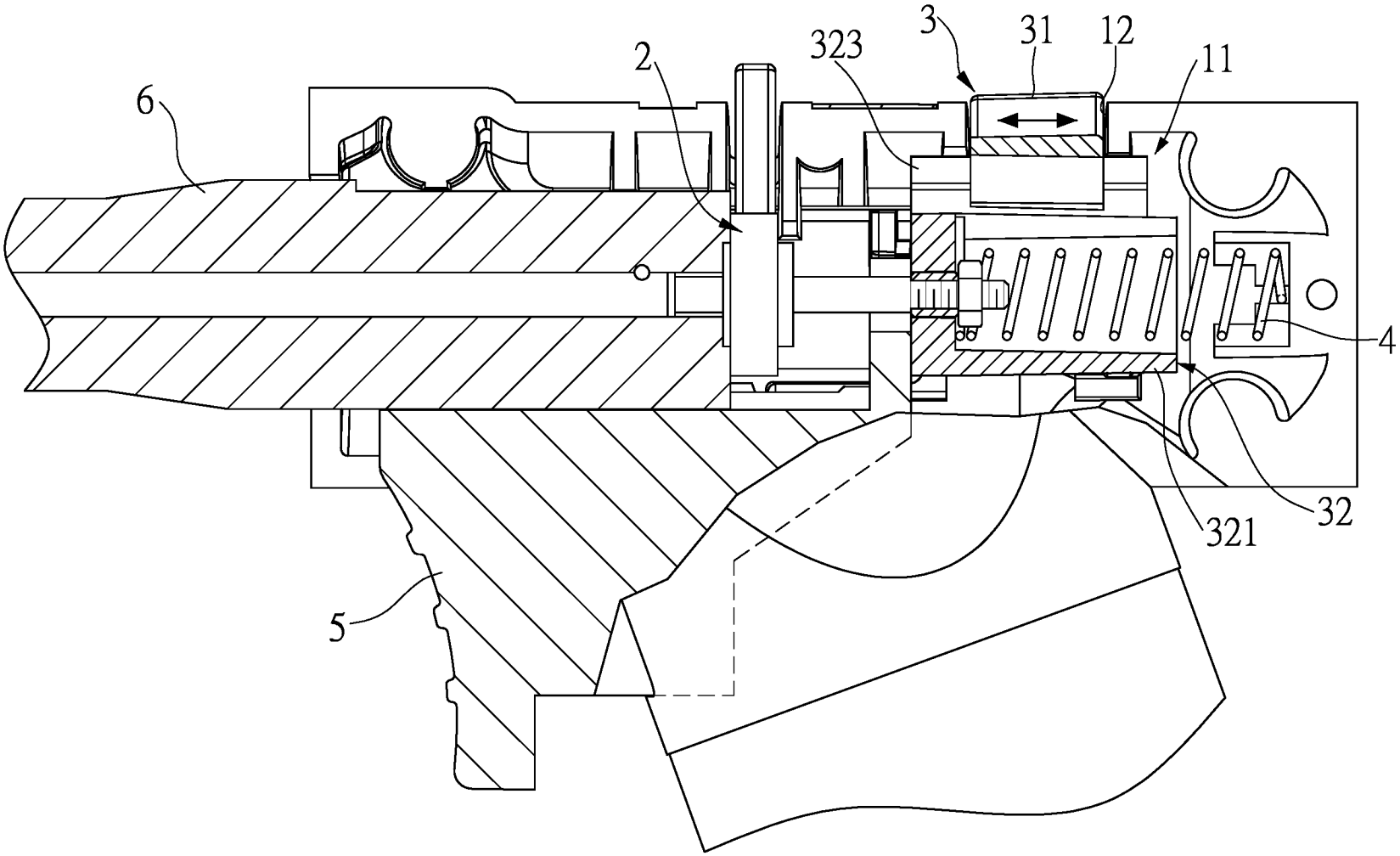
FIG. 2 is a cross sectional view, taken along line II-II in FIG. 1.

Referring to FIGS. 1 to 12, the burner gun of the present invention comprises a case 1 having a burner tube 6 on the first end thereof, and a chamber 11 is defined in the second end of the case 2. The case 1 includes a slot 12 defined therethrough which communicates with the chamber 11. The slot 12 includes a first locking section 121 and a first ignition section 122. The case 1 includes an operation rail 13 formed in the inside thereof which faces the chamber 11. The operation rail 13 includes a second locking section 131 and a second ignition section 132 which is formed with the second locking section 131. An ignition device 2 is located in the chamber 11 and connected with the burner tube 6. A switch 3 includes a lever 31 and a movable part 32, wherein the lever 31 is partially located in the slot 12. The movable part 32 is located in the chamber 11 and includes a body 321 and a protrusion 322 which is formed with the body 321. The body 321 is connected to the ignition device 2 and the lever 31. The protrusion 322 extends from the body 321 and protrudes into the operation rail 13. The body 321 is axially moved to activate the ignition device 2 as shown by the arrows in FIG. 2. A recovery member 4 is located in the chamber 11 and linked to the body 321. An operational part 5 is connected to the case 1. A portion of the operational part 5 protrudes beyond the case 1, and another portion of the operational part 5 is accommodated in the chamber 11 and located corresponding to the body 321. When the lever 31 is shifted along the slot 12 as shown by the arrows in FIG. 3, the lever drives the body 321 in the same direction as the lever 31 moves. When the lever 31 is located at the first locking section 121, the protrusion 322 is located at the second locking position 131. In this status, the body 321 cannot move axially by operating the operational part 5. When the lever 31 is moved to the first ignition section 122, the protrusion 322 is located at the second ignition section 132. In this status, the body 321 moves axially by operating the operational part 5. When the lever 31 and the operational part are released, the recovery member 4 brings the body 321 back in a recovery direction, and the lever 31 moves to the first locking section 121.

The operational part 5 can be any type of operational part such as push-and-press operational part. In this embodiment, the operational part is a conventional trigger.

When the lever 31 is located at the first locking section 121, the protrusion 322 is located at the second locking position 131. Because of the second locking section 131 of the slot 12, the protrusion 322 is restricted from being moved axially away from the burner tube 6, so that the body 321 cannot move axially by operating the operational part 5. This ensures that the burner gun is safely locked, and avoids the ignition device 2 from unintentionally activated by pulling the operational part 5. When the user wants to re-activate the ignition device 2, the lever 31 needs to be shifted to the first ignition section 122 to move the protrusion 322 to the second ignition section 132 so as to be separated from the second locking position 131. In this status, by pulling the operational part 5, the body 321 moves to activate the ignition device 2. When releasing the operational part 5 and the lever 31, the flame stops, the recovery member 4 brings the body 321 back, and the lever 31 moves back to the first locking section 121. The protrusion 322 moves to the second locking section 131 to automatically lock the burner gun. The safe feature of the present invention effectively avoids the burner gun from operation by unintentionally pulling the operational part 5, so as to reduce the possibility of causing fire disasters.

Figure 4:
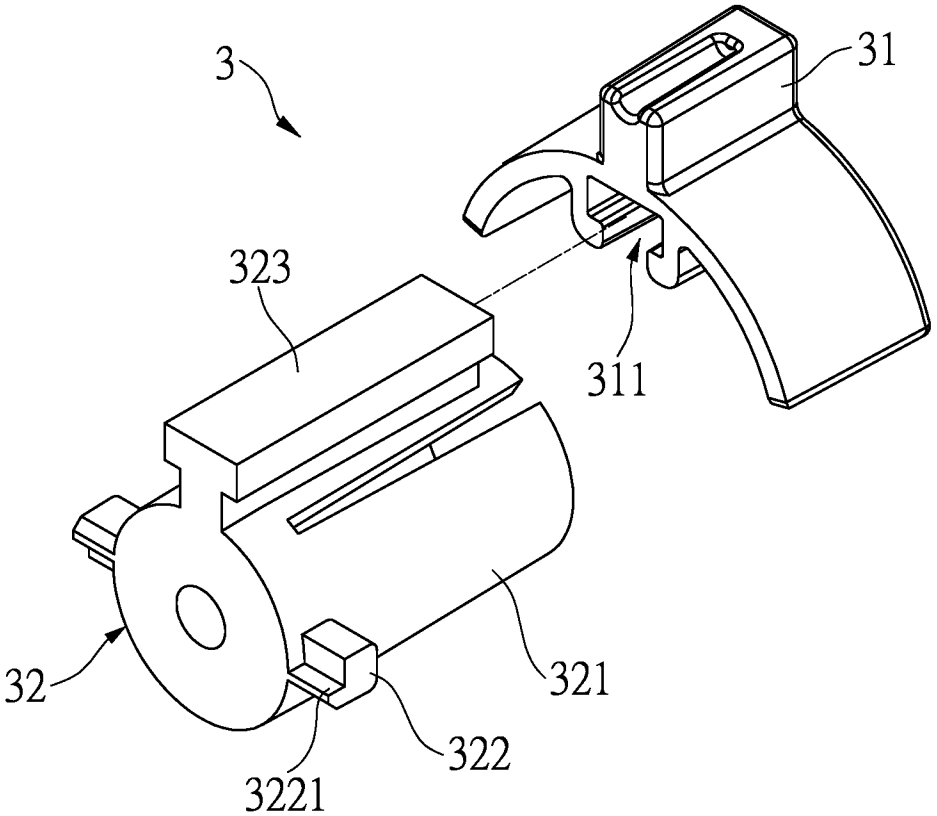
FIG. 4 is an exploded view of the switch of the burner gun of the present invention.

The body 321 may include two protrusions 322 as shown in FIG. 4 on two sides thereof, wherein the one of the two protrusions 322 is up-side-down in shape relative to the other one of the two protrusions 322. The case 1 includes two operational rails 13 (not shown) that are shaped corresponding to the two protrusions 322.

As shown in FIGS. 5 to 9, a contact face 1311 is formed to a lateral side of the operation rail 13. When the protrusion 322 is located at the second locking section 131, the protrusion 322 contacts the contact face 1311 from a direction opposite to the recovery direction of the body 321. Therefore, the body 321 cannot move axially by operating the operational part 5. This preferable embodiment discloses how the slot 12 restricts the axial movement of the protrusion 322 by the second locking section 131.

Figure 5:
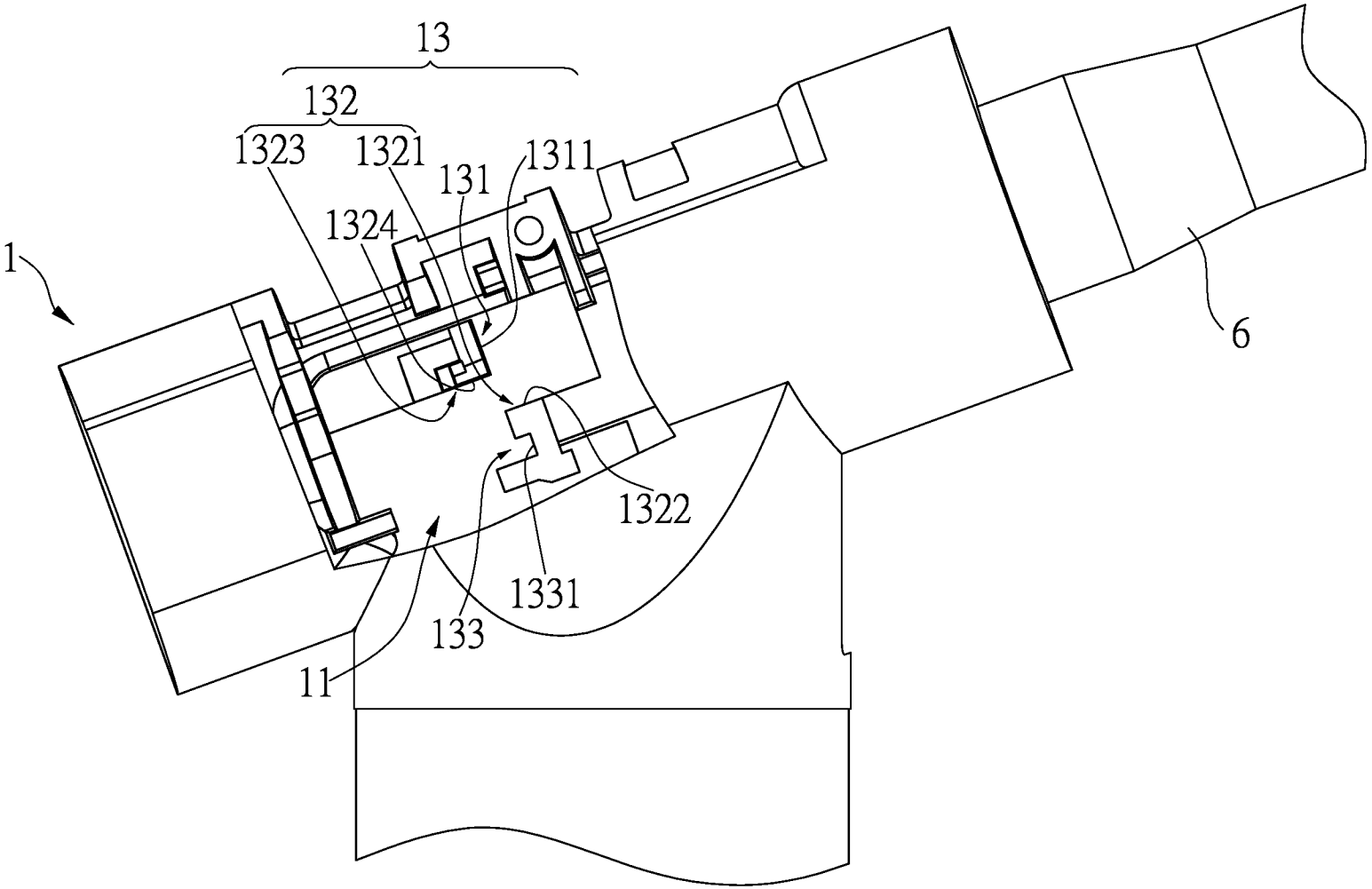
FIG. 5 illustrates operation rail of the case of the burner gun of the present invention.
Figure 6:
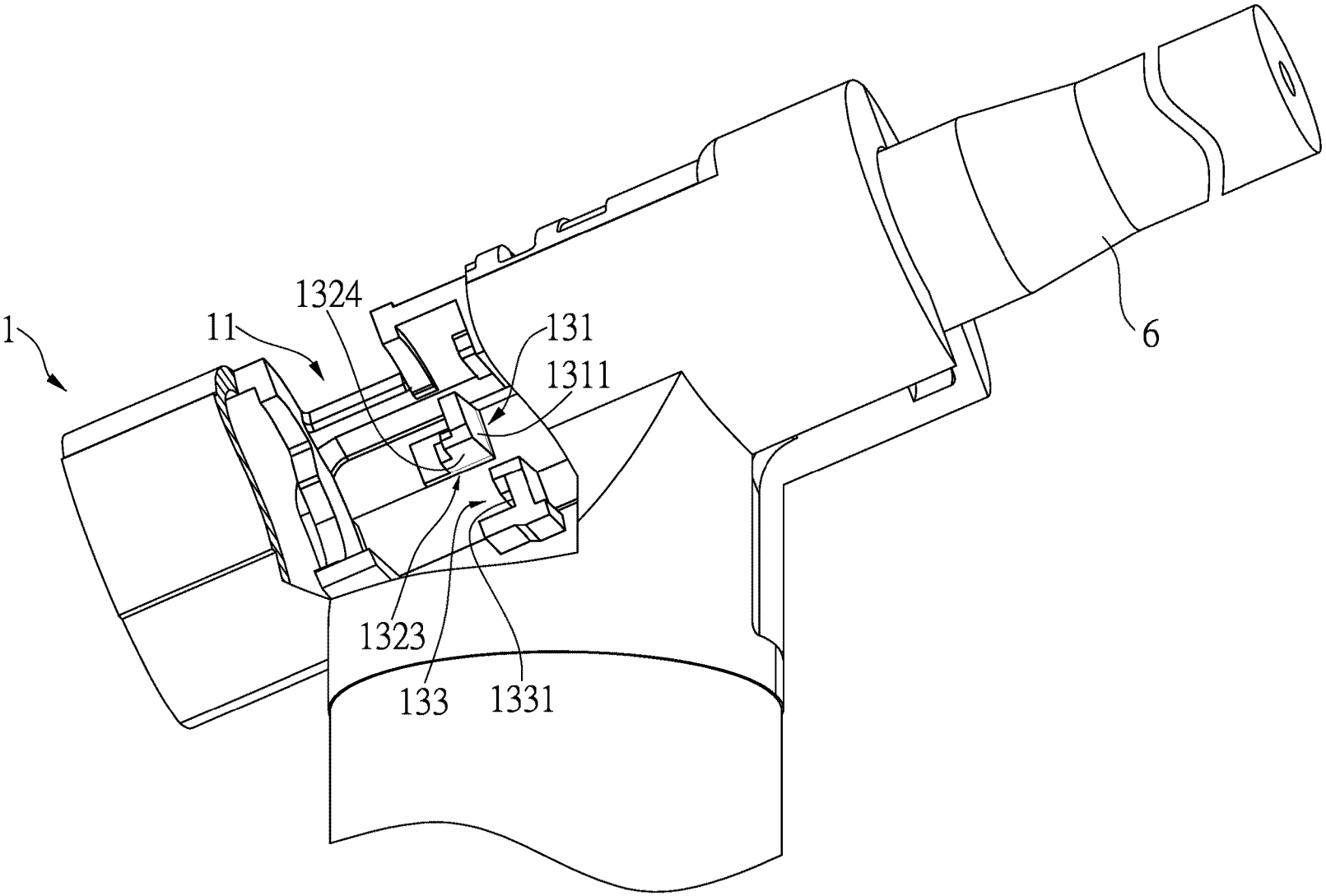
FIG. 6 is a perspective view to show the operation rail of the case of the burner gun of the present invention.
Figure 7:
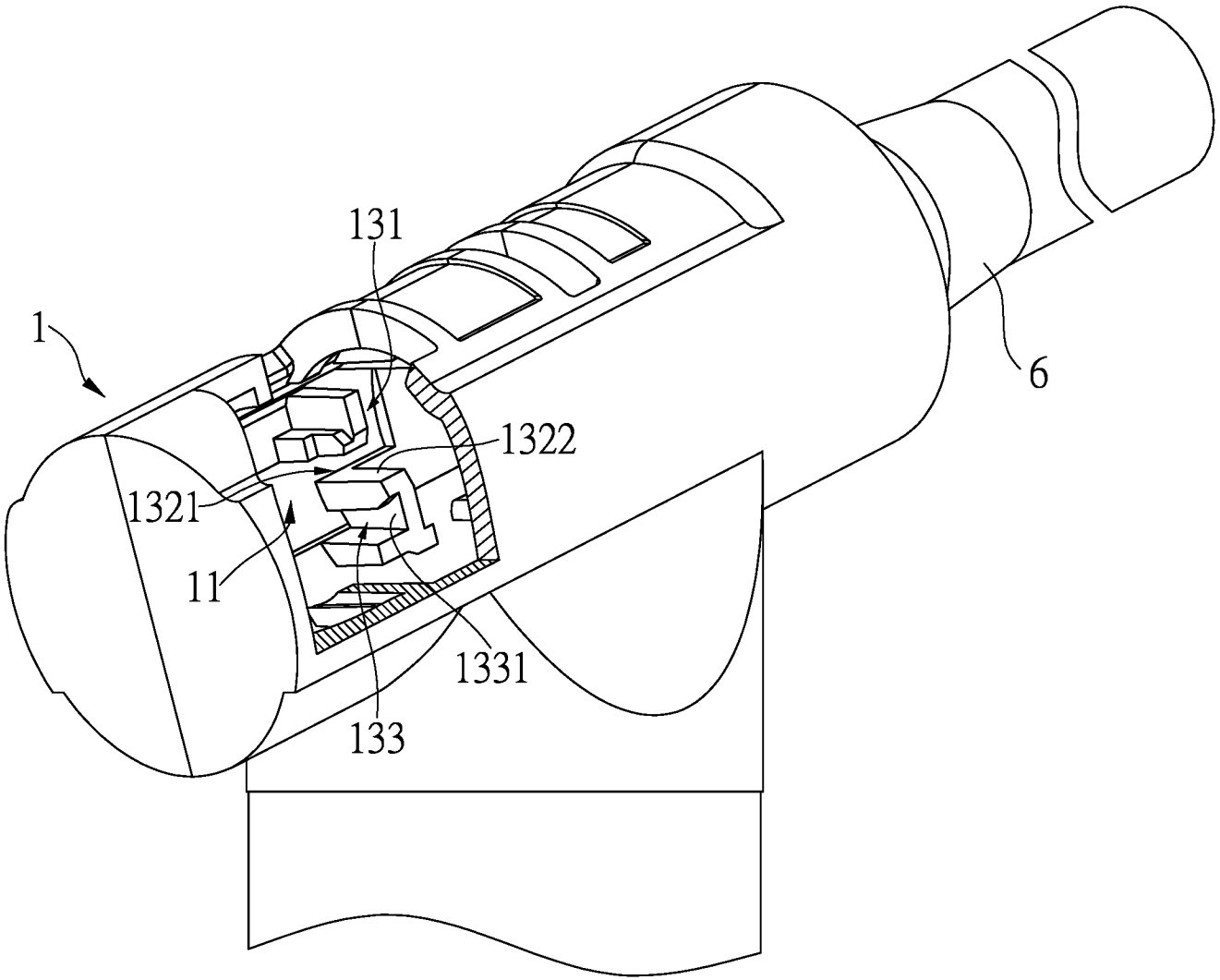
FIG. 7 is yet another perspective view to show the operation rail of the case of the burner gun of the present invention.
Figure 8:
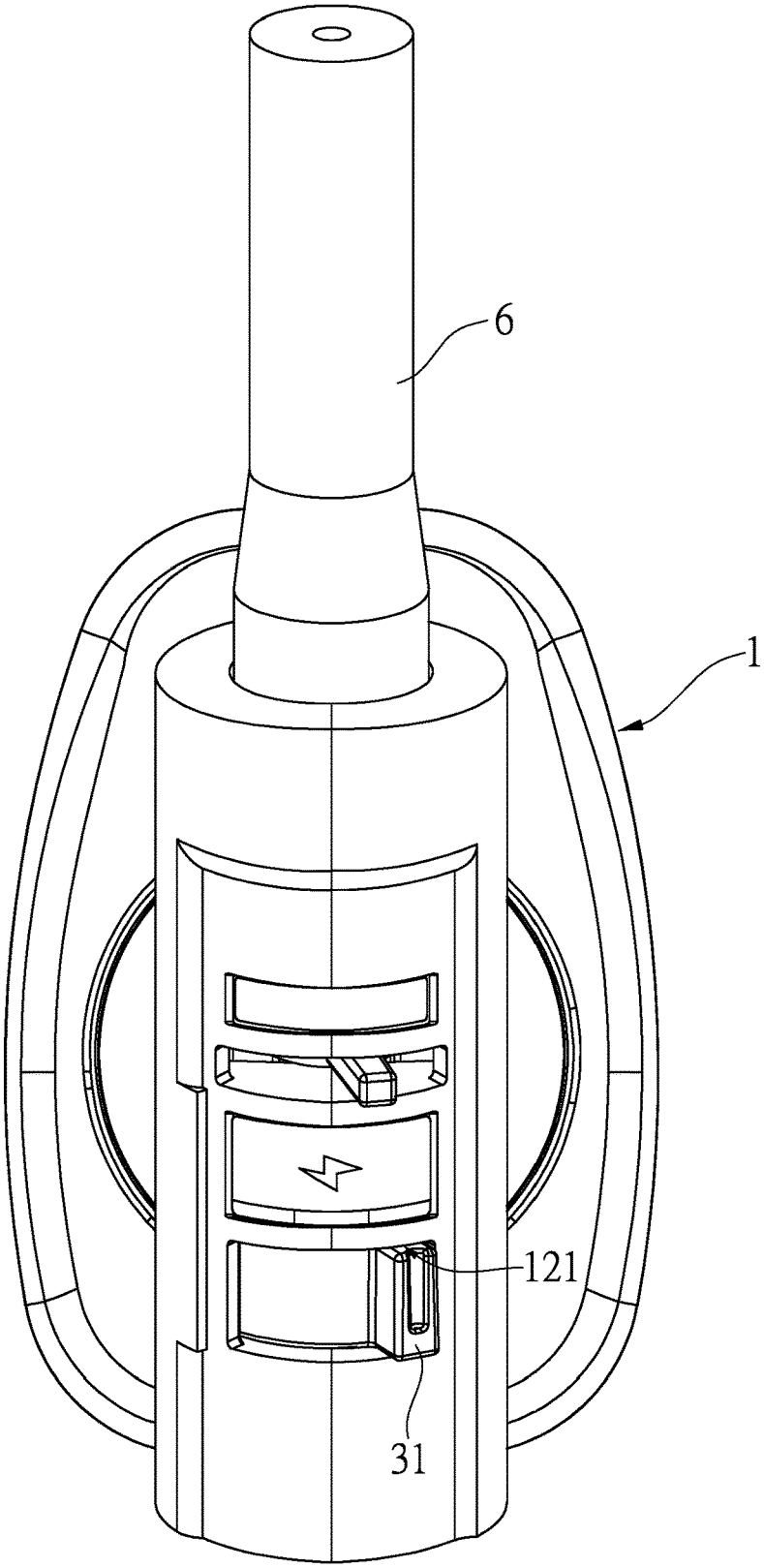
FIG. 8 shows that the lever is located at the first locking section.
Figure 9:
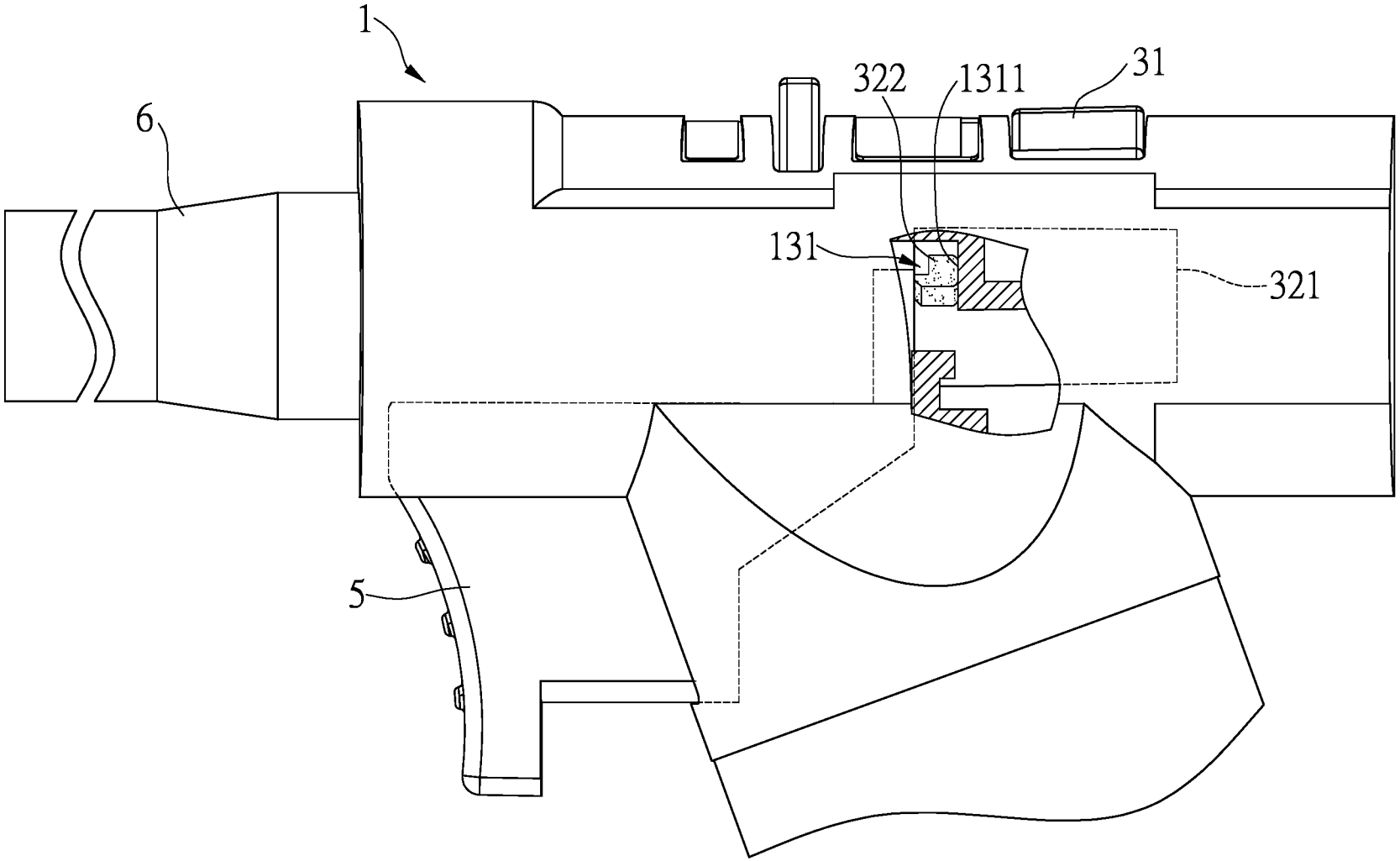
FIG. 9 shows that the lever is located at the second locking section.
Figure 10:
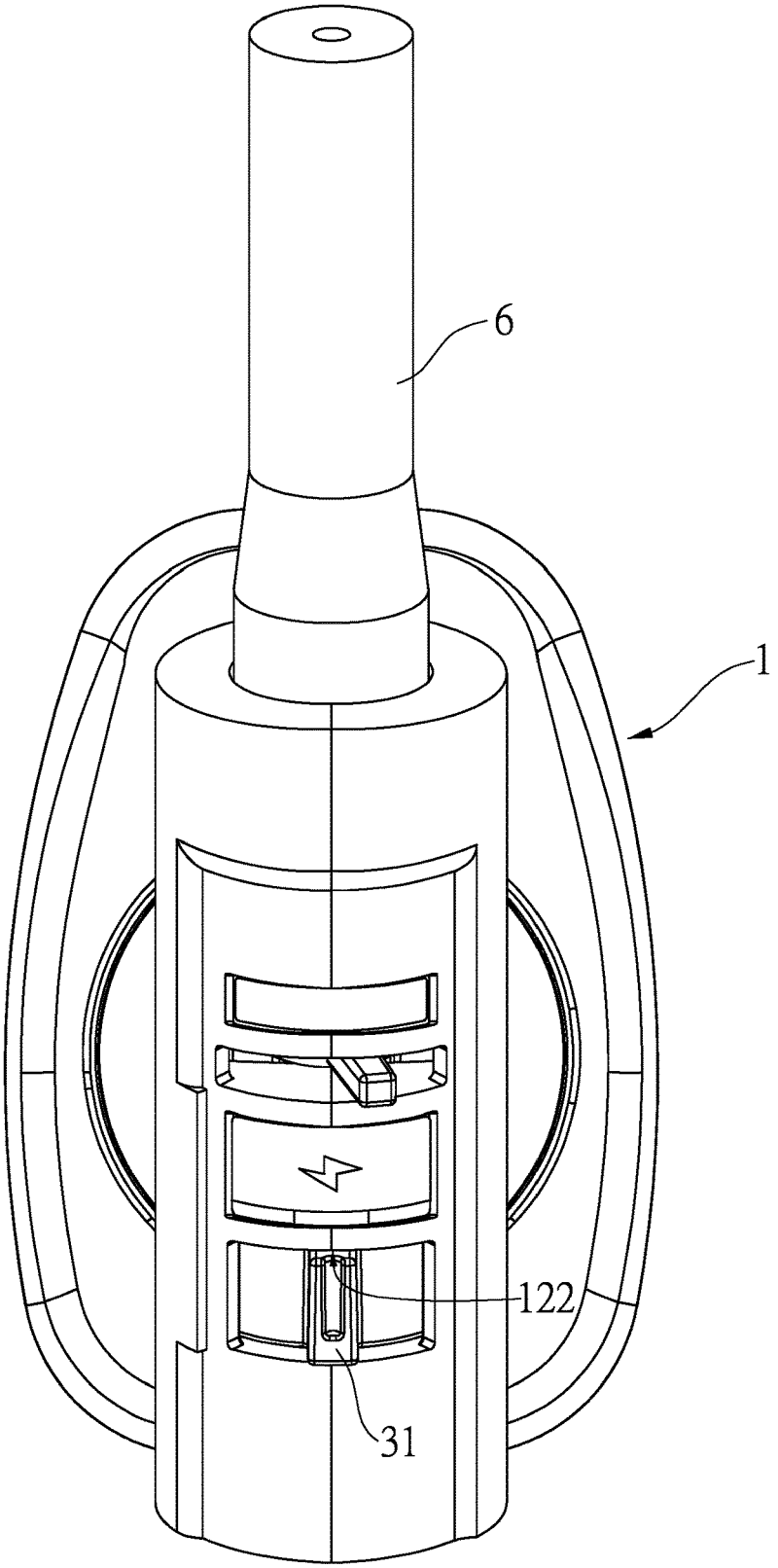
FIG. 10 shows that the lever is located at the first ignition section.

As shown in FIGS. 5 to 7, the slot 12 includes a first operation section 123. The first ignition section 122 is connected between the first locking section 121 and the first operation section 123. The operation rail 13 includes a second operation section 133. The second ignition section 132 is connected between the second locking section 131 and the second operation section 133. As shown in FIGS. 9 to 15, when the operational part 5 is pulled and the lever 31 is shifted to the first operation section 123, the protrusion 322 is located at the second operation section 133. When the operational part 5 is released, the protrusion 322 is positioned at the second operation section 133, the recovery member 4 cannot bring the body 321 back. This means that when the user wants to provide the flame continuously for a period of time, he or she does not need to keep on pressing the lever 31, and the operational part 5 does not automatically locked.

Figure 11:
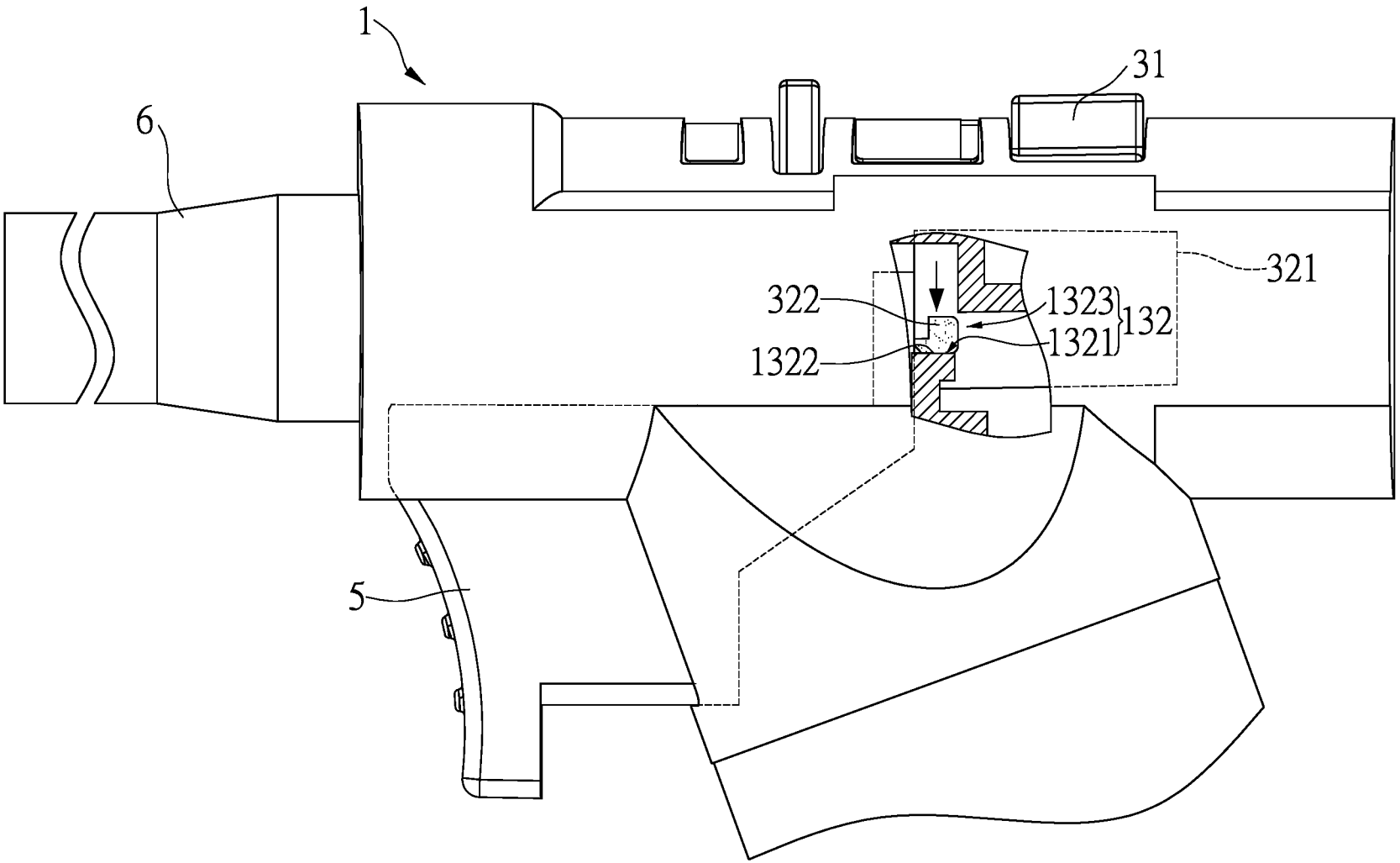
FIG. 11 shows that the protrusion is located at the first portion of the second ignition section.
Figure 12:
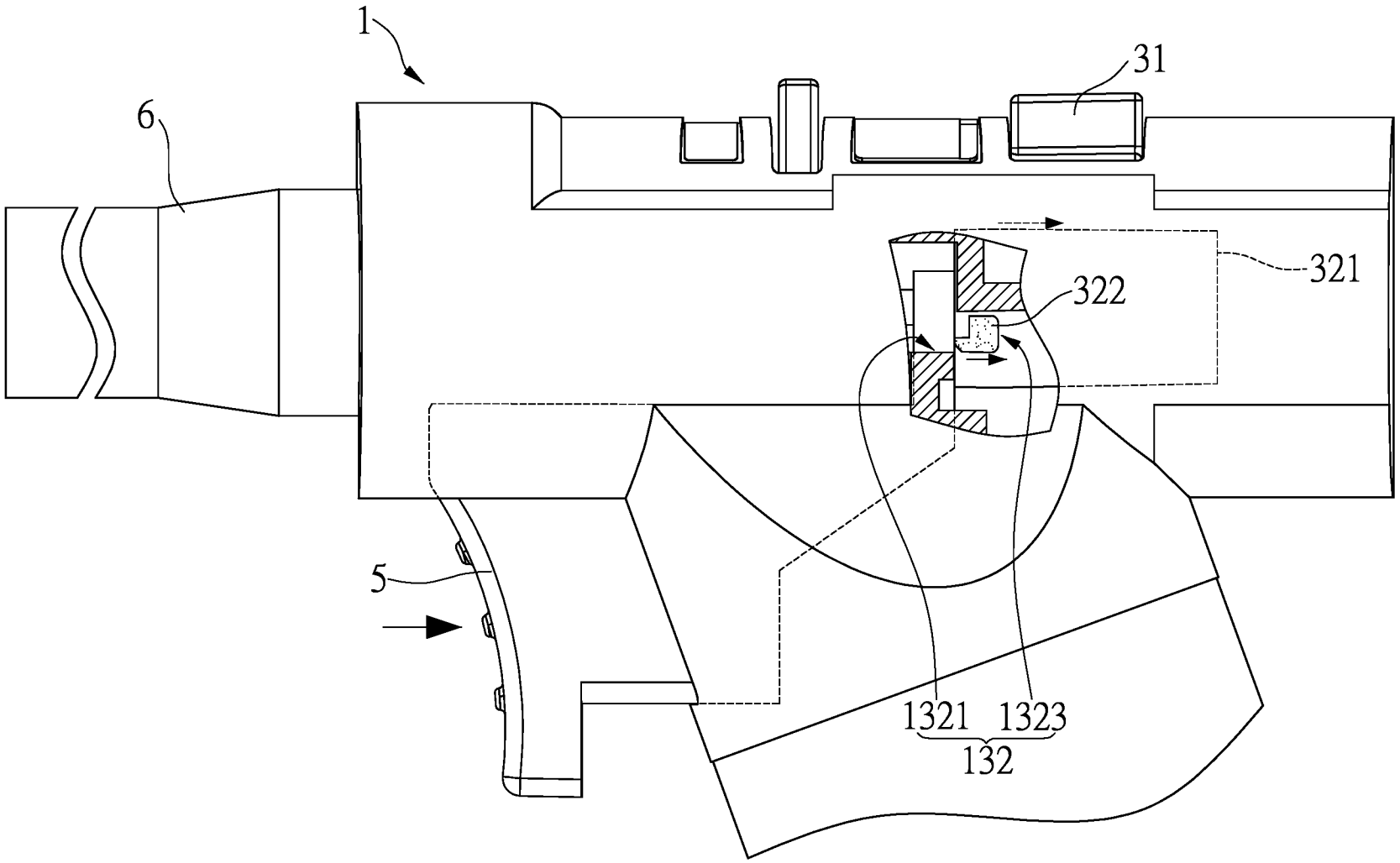
FIG. 12 shows that the protrusion is located at second portion of the second ignition section.
Figure 13:
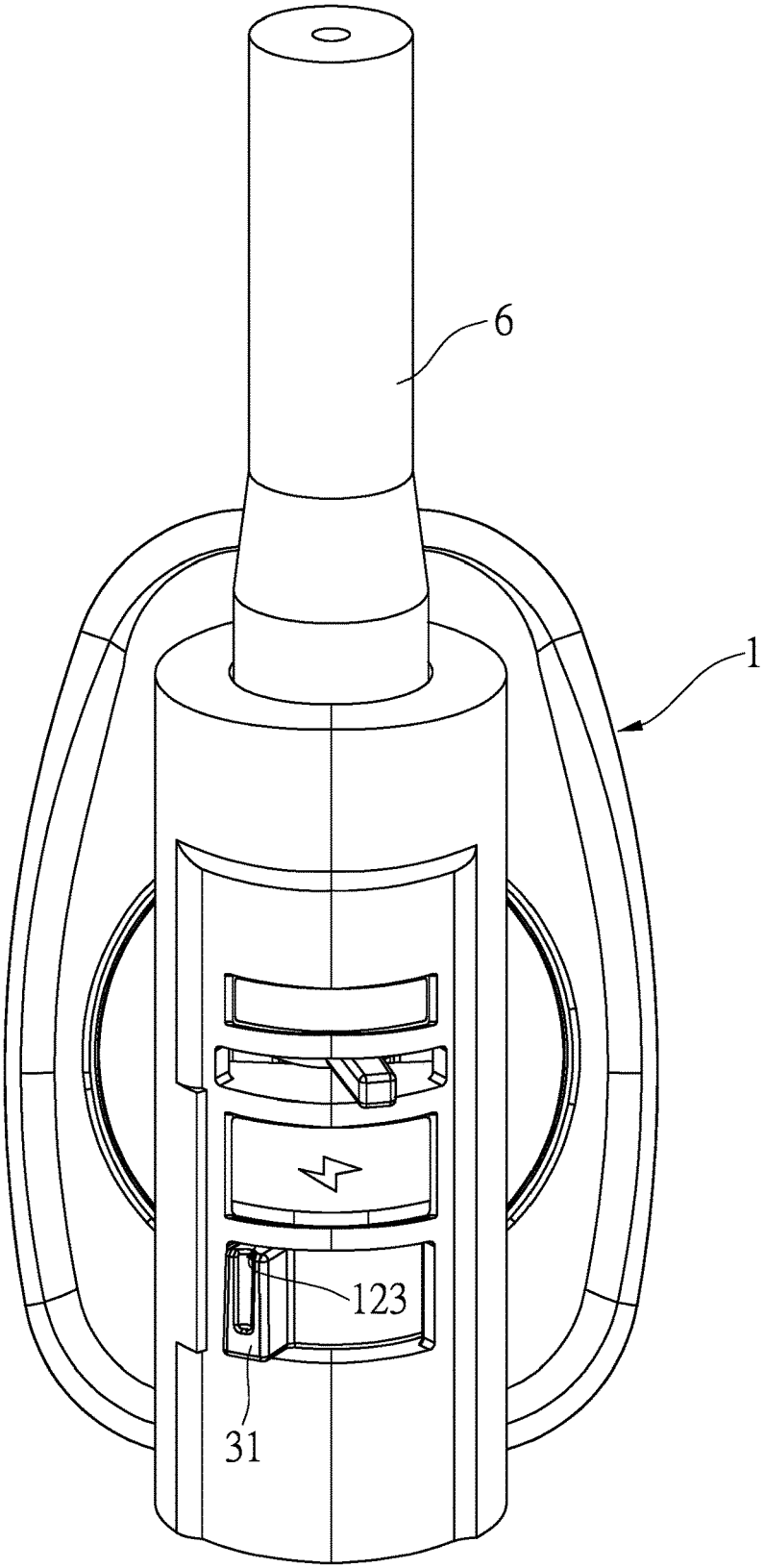
FIG. 13 shows that the lever is located at the first operation section.
Figure 14:
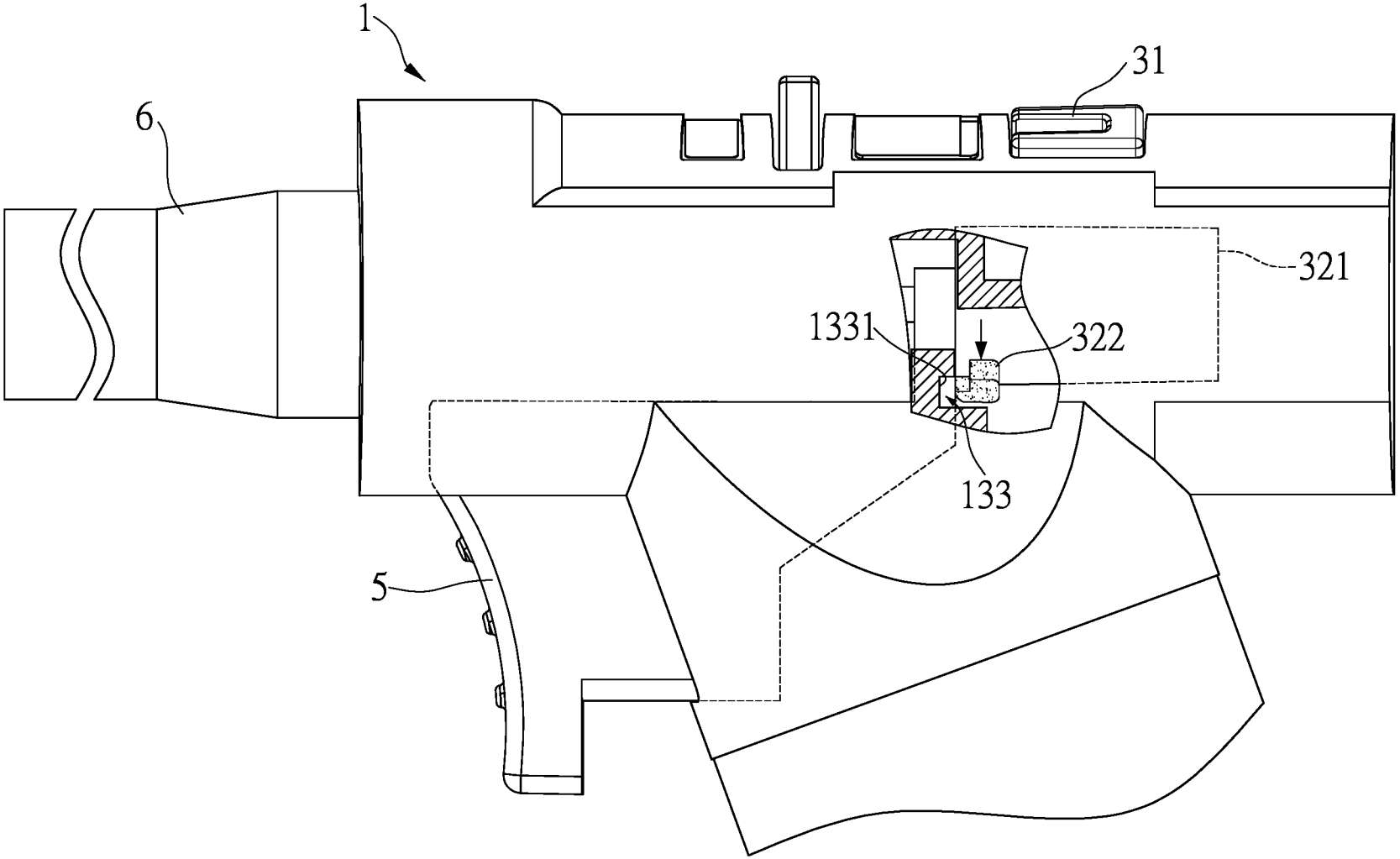
FIG. 14 shows that the protrusion is located at the second operation section.
Figure 15:
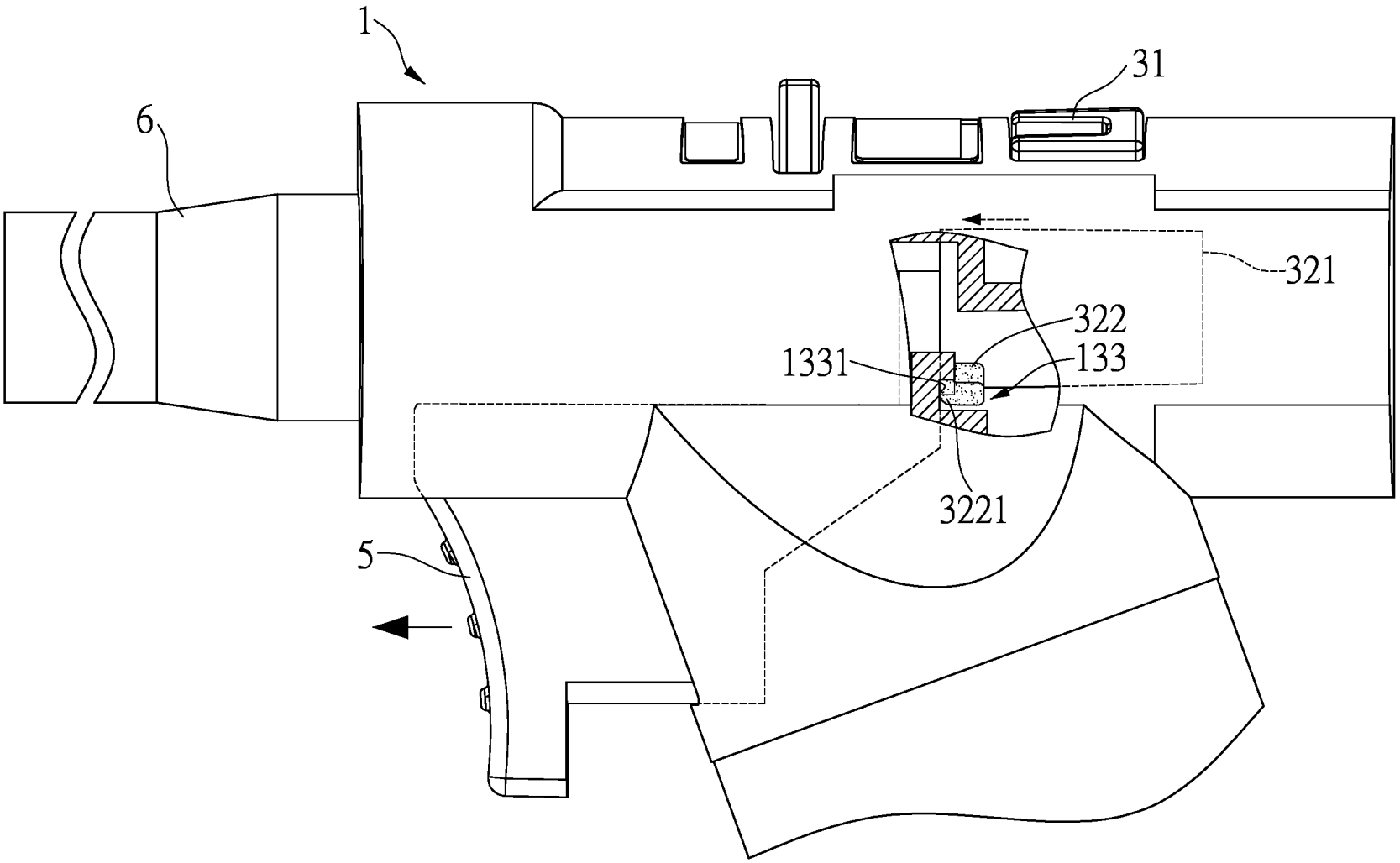
FIG. 15 shows that the latch of the protrusion is engaged with the notch.

As shown in FIGS. 5 to 7, the second ignition section 132 includes a first portion 1321 and a second portion 1323 which is formed with the first portion 1321. The first portion 1321 is connected to the second locking section 131. The second portion 1323 is connected to the second operation section 133. The operation rail 13 includes a first face 1322 at the first portion 1321. As shown in FIG. 11, when the protrusion 322 contacts the first face 1322, the lever 31 cannot move to the first operation section 123, in this status, when the operational part 5 is continuously operated, as shown in FIG. 12, the body 321 moves axially and drives the protrusion 322 to the second portion 1323, and the lever 31 can be shifted to the first operation section 123 as shown in FIGS. 13 and 14. Under the status of applying a force to the lever 31 continuously and releasing the operational part 5, the protrusion 322 is positioned at the second operation section 133 as shown in FIG. 15. The specific feature increases the step for moving the lever 31 to the first operation section 123, and also prevents the automatic locking feature from being unintentionally activated due to overly easy of operation.

As shown in FIGS. 5 to 15, the protrusion 322 includes a latch 3221 which extends toward the axial recovery direction of the body 321. The operation rail 13 includes a notch 1331 defined in the lateral wall of the second operation section 133. When the protrusion 322 is positioned at the second operation section 133, the latch 3221 is engaged with the notch 1331. In this status, when the operational part 5 is operated again, the body 321 moves axially to drive the protrusion 322 to separate the latch 3221 from the notch 1331. When the latch 3221 is separated from the notch 1331, because of the recovery member 4, the protrusion 322 contacts the second face 1324 first to prevent from being disengaged, and the recovery member 4 then sets the automatic locking feature. The structure discloses how the protrusion 322 is positioned in the second operation section 133.

Figure 3:
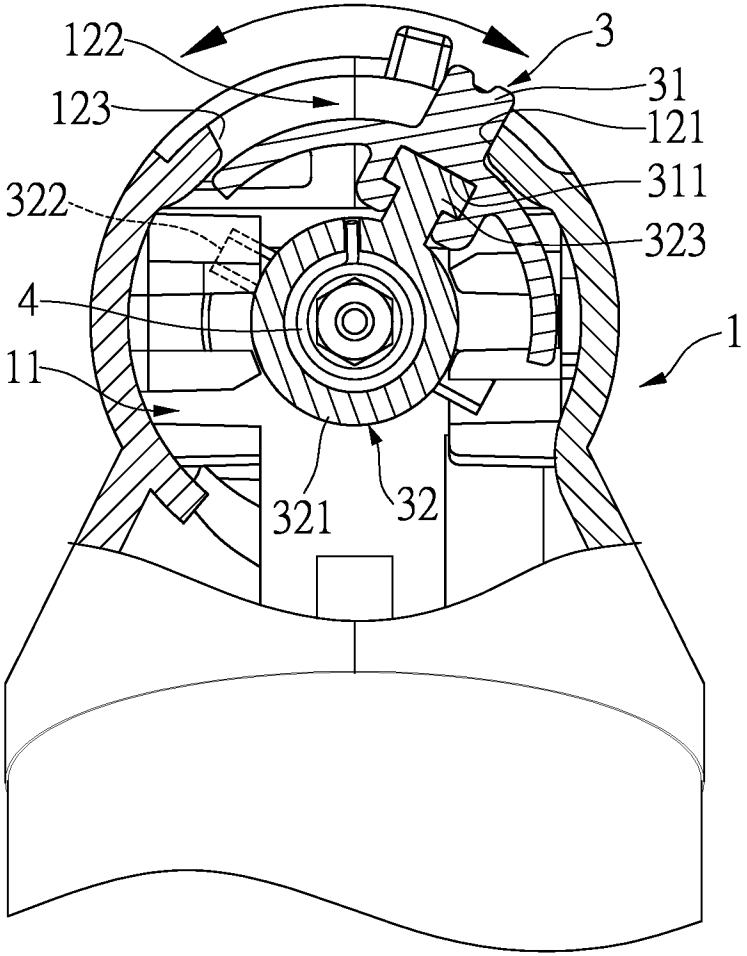
FIG. 3 is a cross sectional view, taken along line III-III in FIG. 1.

As shown in FIGS. 3 and 4, the body 321 includes a ridge 323 protruding toward the lever 31. The ridge 323 extends axially along the body 321. The lever 31 includes a passage 311 formed axially thereto, and the ridge 323 slidably engaged with the passage 311. This structure discloses that the lever 31 drives the body 321 to move radially, while does not affect the axial movement of the body 321.

Figure 16:
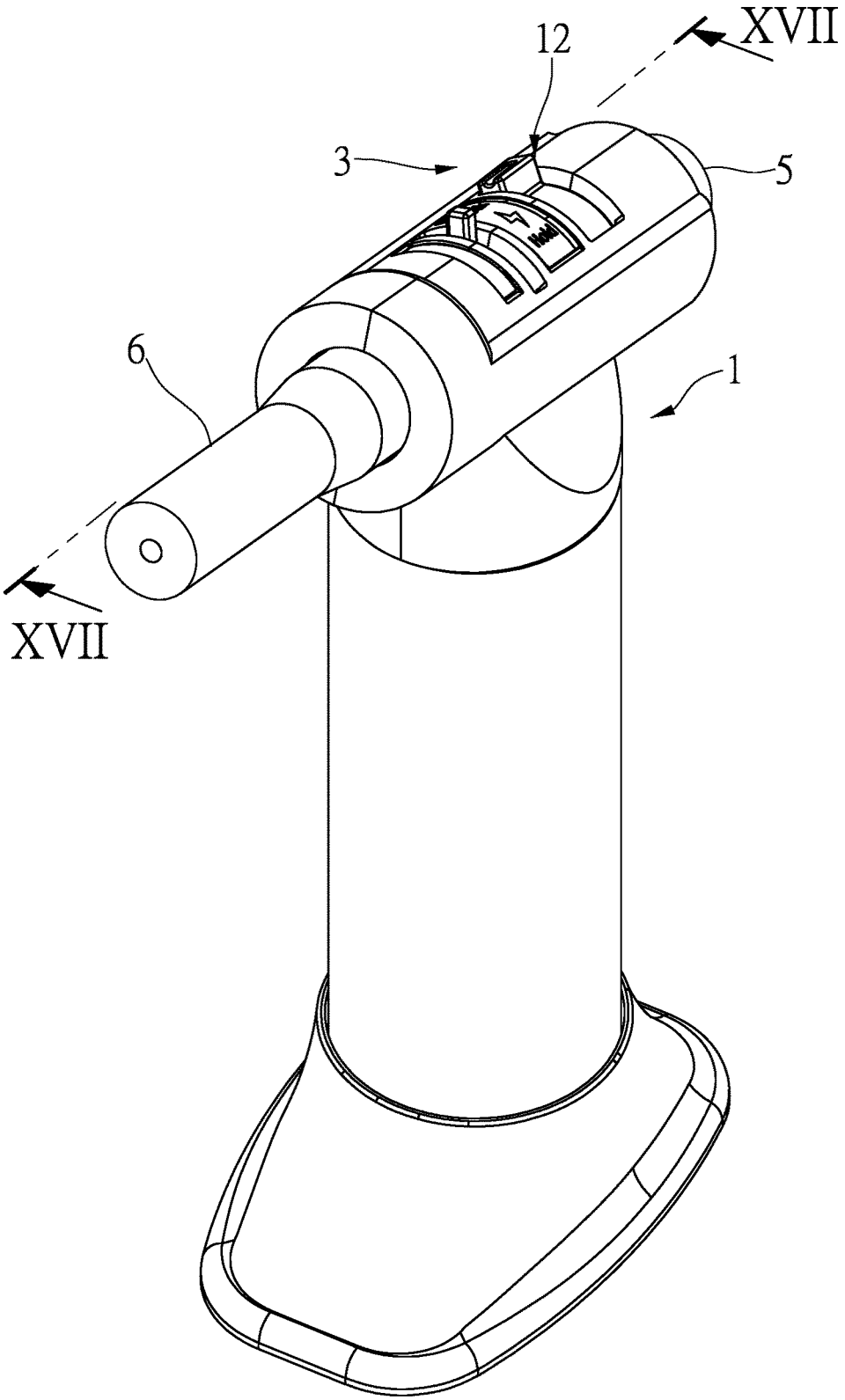
FIG. 16 is a perspective view to show the second embodiment of the burner gun of the present invention.
Figure 17:
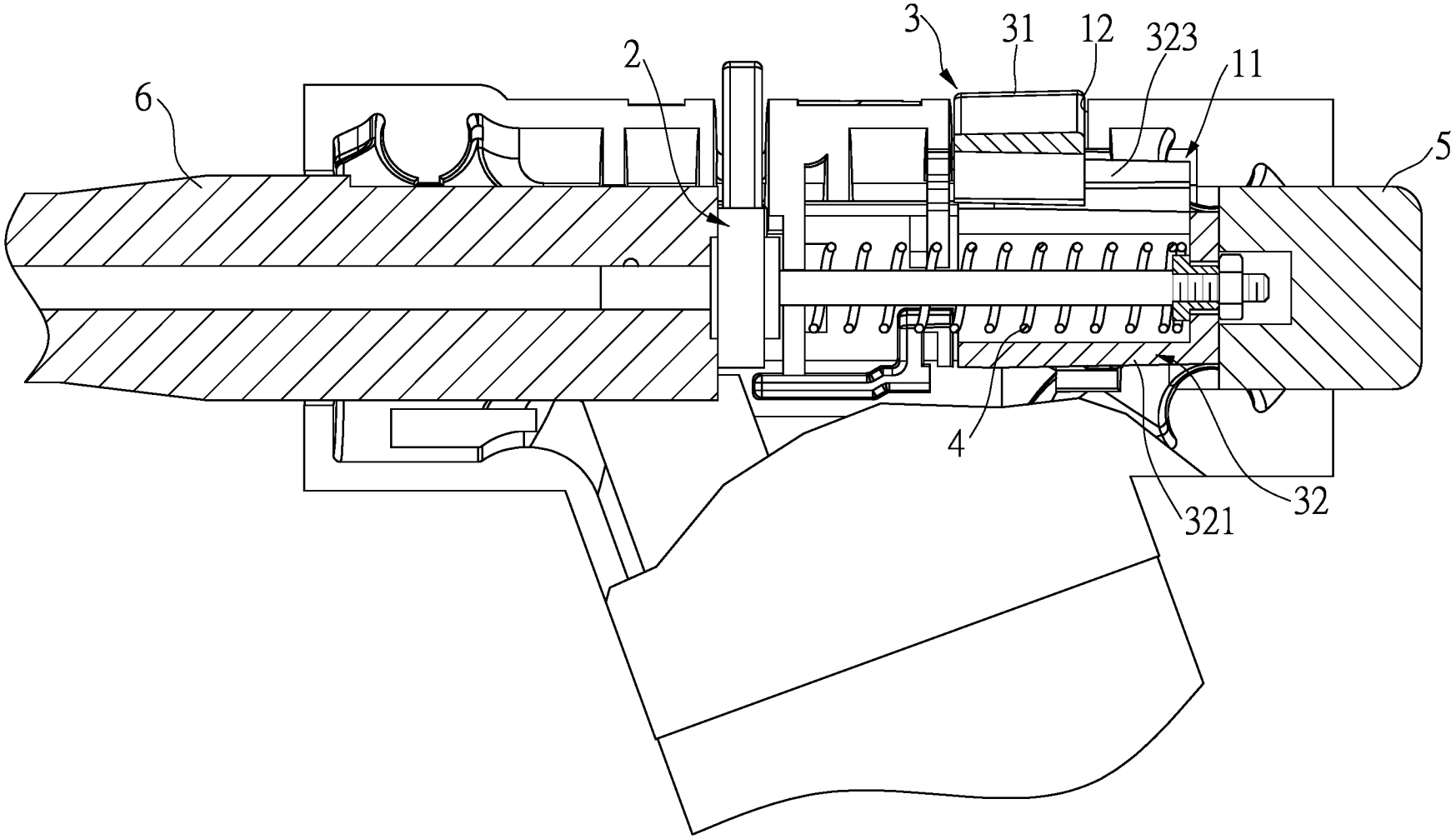
FIG. 17 is a cross sectional view, taken along line XVII-XVII in FIG. 16.

As shown in FIGS. 16 and 17, the second embodiment discloses that the operational part 5 and the movable part 32 are moved in the opposition direction in the first embodiment. The operation rail 13 is also arranged in opposite way to achieve the same function as the first embodiment.

While we have shown and described the embodiment in accordance with the present invention, it should be clear to those skilled in the art that further embodiments may be made without departing from the scope of the present invention.

What is claimed is:

1. A burner gun comprising:

a case having a burner tube on a first end thereof, a chamber defined in a second end of the case, the case including a slot which communicates with the chamber, the slot including a first locking section and a first ignition section, the case including an operation rail formed in an inside thereof which faces the chamber, the operation rail including a second locking section and a second ignition section which is formed with the second locking section;

an ignition device located in the chamber and connected with the burner tube;

a switch including a lever and a movable part, the lever partially located in the slot, the movable part located in the chamber and including a body and a protrusion which is formed with the body, the body connected to the ignition device and the lever, the protrusion extending from the body and protruding into the operation rail, the body axially moved to activate the ignition device;

a recovery member located in the chamber and linked to the body, and an operational part connected to the case, a portion of the operational part protruding beyond the case, another portion of the operational part accommodated in the chamber and located corresponding to the body, when the lever being shifted along the slot, the lever drives the body in the same direction as the lever moves; when the lever is located at the first locking section, the protrusion is located at the second locking position, the body cannot move axially by operating the operational part; when the lever is moved to the first ignition section, the protrusion is located at the second ignition section, the body moves axially by operating the operational part; when the lever and the operational part are released, the recovery member brings the body back in a recovery direction, and the lever moves to the first locking section.

2. The burner gun as claimed in claim 1, wherein a contact face is formed to a lateral side of the operation rail, when the protrusion is located at the second locking section, the protrusion contacts the contact face from a direction opposite to the recovery direction of the body.

3. The burner gun as claimed in claim 1, wherein the slot includes a first operation section, the first ignition section is connected between the first locking section and the first operation section, the operation rail includes a second operation section, the second ignition section is connected between the second locking section and the second operation section, when the operational part is pulled and the lever is shifted to the first operation section, the protrusion is located at the second operation section, when the operational part is released, the protrusion is positioned at the second operation section, the recovery member cannot bring the body back.

4. The burner gun as claimed in claim 3, wherein the second ignition section includes a first portion and a second portion which is formed with the first portion, the first portion is connected to the second locking section, the second portion is connected to the second operation section, the operation rail includes a first face at the first portion, when the protrusion contacts the first face, the lever cannot move to the first operation section, when the operational part is continuously operated, the body moves axially and drives the protrusion to the second portion, and the lever is shifted to the first operation section.

5. The burner gun as claimed in claim 3, wherein the protrusion includes a latch which extends toward the axial recovery direction of the body, the operation rail includes a notch defined in a lateral wall of the second operation section, when the protrusion is positioned at the second operation section, the latch is engaged with the notch, and the operational part is operated, the body moves axially to drive the protrusion to separate the latch from the notch.

6. The burner gun as claimed in claim 1, wherein the body includes a ridge protruding toward the lever, the ridge extends axially along the body, the lever includes a passage formed axially thereto, the ridge slidably engaged with the passage.

* * * * *